US007591761B1

(12) United States Patent
Ellis

(10) Patent No.: US 7,591,761 B1
(45) Date of Patent: Sep. 22, 2009

(54) WALKING/JOGGING EXERCISE MACHINE WITH ARTICULATED CAM FOLLOWER ARRANGEMENT

(75) Inventor: Patrick D. Ellis, Milwaukee, WI (US)

(73) Assignee: Northland Industries, South Milwaukee, WI (US)

( * ) Notice: Subject to any disclaimer, the term of this patent is extended or adjusted under 35 U.S.C. 154(b) by 516 days.

(21) Appl. No.: 11/413,037

(22) Filed: Apr. 27, 2006

(51) Int. Cl.
*A63B 22/04* (2006.01)
*A63B 69/10* (2006.01)

(52) U.S. Cl. ..... 482/52; 482/57

(58) Field of Classification Search ..... 482/51, 482/52, 57, 70, 79, 80
See application file for complete search history.

(56) References Cited

U.S. PATENT DOCUMENTS

| | | | | |
|---|---|---|---|---|
| 3,316,898 | A | 5/1967 | Brown | |
| 5,562,574 | A | 10/1996 | Miller | |
| 5,823,917 | A | 10/1998 | Chen | |
| 5,836,854 | A | 11/1998 | Kuo | |
| 5,846,166 | A | 12/1998 | Kuo | |
| 5,882,281 | A | 3/1999 | Stearns et al. | |
| 5,899,833 | A | 5/1999 | Ryan et al. | |
| 5,947,872 | A | 9/1999 | Ryan et al. | |
| 6,019,710 | A | 2/2000 | Dalebout et al. | |
| 6,042,512 | A * | 3/2000 | Eschenbach | 482/52 |
| 6,090,013 | A | 7/2000 | Eschenbach | |
| 6,099,439 | A | 8/2000 | Ryan et al. | |
| 6,126,574 | A * | 10/2000 | Stearns et al. | 482/52 |
| 6,135,926 | A | 10/2000 | Lee | |
| 6,176,814 | B1 | 1/2001 | Ryan et al. | |
| 6,217,485 | B1 | 4/2001 | Maresh | |
| 6,254,514 | B1 | 7/2001 | Maresh et al. | |
| 6,390,954 | B1 * | 5/2002 | Lee | 482/52 |
| 6,398,695 | B2 | 6/2002 | Miller | |
| 6,758,790 | B1 | 7/2004 | Ellis | |
| 7,201,705 | B2 * | 4/2007 | Rodgers, Jr. | 482/52 |
| 7,214,168 | B2 * | 5/2007 | Rodgers, Jr. | 482/52 |

* cited by examiner

*Primary Examiner*—Steve R Crow
(74) *Attorney, Agent, or Firm*—Andrus, Sceales, Starke & Sawall, LLP

(57) ABSTRACT

A walking/jogging exercise machine includes a machine frame supported upon a generally horizontally extending floor. A shaft is mounted for rotation on the machine frame, and a pair of cams is mounted for rotation on the shaft. A pair of movable track assemblies has rear portions with rear ends pivotally connected to the machine frame, and front portions with movable front ends. A pair of articulated cam follower assemblies extend between the machine frame and the front ends of the track assembly front portions. The cam follower assemblies include cam rollers operably engaged upon peripheries of the cams, and the cam follower assemblies move in response to rotation of the cams. A pair of foot assemblies is mounted for sliding movement on the track assemblies. A linkage arrangement between the cams and the foot assemblies is provided for transferring movement of the foot assemblies to the cams such that the articulated cam follower assemblies enable a leveraged range of up and down movement of the track assemblies to product an increase in bending of a user's knees resulting in a enhanced natural stepping motion.

15 Claims, 7 Drawing Sheets

WALKING/JOGGING EXERCISE MACHINE WITH ARTICULATED CAM FOLLOWER ARRANGEMENT

FIELD OF THE INVENTION

The present invention relates generally to walking and jogging conditioning devices and, more particularly, pertains to standup exercise equipment wherein a user's feet travel through a curved path of travel to produce a more natural motion of walking or jogging.

BACKGROUND OF THE INVENTION

Recognizing the benefits of exercise contrasted with the various constraints of time and space limiting exercisers in using their lower and upper body muscles, various walking/jogging machines have been designed to provide for physical development and aerobic exercise. It is generally desirable to create a machine that will allow a user to walk or jog without the impact on the user's joints that occur while running on the ground or on a treadmill. There are a number of elliptical machines on the market today which achieve this result, but force the users into an unnatural motion.

In the inventor's previous U.S. Pat. No. 6,758,790, issued Jul. 6, 2004, a walking/jogging exercise machine includes a frame supported upon a generally horizontally extending floor, and a main driveshaft mounted for rotation on the frame. A pair of cams is mounted for rotation on the driveshaft, and a pair of first track assemblies are affixed to the frame. A pair of second track assemblies is rotatably attached to the frame and includes brackets having first rollers which ride upon the peripheries of the cams. A pair of non-aligned, foot assemblies are mounted for sliding movement on the first and second track assemblies. A linkage arrangement is provided between the driveshaft and the foot assemblies for transferring the movement of the foot assemblies to the cams so as to produce a change in the angle of a user's ankle which will result in a natural walking/jogging motion.

While the exercise machine disclosed in the '790 patent has performed generally satisfactorily, it is felt that the walking/jogging machine can be restructured to provide a more enhanced stepping and striding motion. In particular, it is desirable to improve upon the increase in bending of a user's knees concurrent with the change in the user's heel-to-toe movement.

SUMMARY OF THE INVENTION

It is a general object of the present invention to provide an exercising machine which enables an individual to exercise lower and upper body muscles over a range of motion.

It is also an object of the present invention to provide an exercise machine which permits one's feet to move along a smooth path during exercise.

It is a further object of the present invention to provide an exercise machine which utilizes a driving and cam arrangement and a linkage system to produce a low impact, naturally ambulatory motion.

It is an additional object of the present invention to provide a walking/jogging exercise machine having an articulated cam follower arrangement which will result in an improved knee bending motion.

In one aspect of the invention, a walking/jogging machine includes a machine frame supported on a generally horizontally extending floor. A shaft is mounted for rotation on the machine frame, and a pair of cams is mounted for rotation on the shaft. A pair of movable track assemblies is provided with each having rear portions with rear ends pivotally connected to the machine frame, and front portions with movable front ends. A pair of articulated cam follower assemblies extends between the machine frame and the front ends of the track assembly front portions, and include cam rollers operably engaged upon peripheries of the cams. The cam follower assemblies move in response to rotation of the cams. A pair of foot assemblies is mounted for sliding movement on the track assemblies. A linkage arrangement is provided between the cams and the foot assemblies for transferring movement of the foot assemblies to the cams such that the articulated cam follower assemblies enable a leveraged range of up and down movement of the track assemblies to produce an increase in a bending of the user's knees resulting in a natural stepping motion.

The machine frame includes an elongated base member engaged with the floor, a first upwardly rising support member joined to the base member, a second upwardly rising support member spaced rearwardly of the first support member and affixed to the base member, a support brace interconnecting the first and second support members, and a transverse support member joined to the first support member and the base and engaged with the floor. A circular drive pulley is mounted for rotation on the shaft between the cams. A brake assembly is attached to the machine frame beneath the cams and is entrained with the drive pulley by a drive belt. The machine frame carries an electronic controller operably connected to the brake assembly for providing resistance to the drive pulley. The rear portions of the track assemblies extend horizontally and the front portions of the track assemblies extend at an angle relative to the rear portion and are formed integrally therewith. Each front portion of the track assembly extends at an acute angle relative to a horizontal plane of an upper surface of each rear portion. The foot assemblies include support braces having rearward ends which ride back and forth on the rear portions of the track assemblies. The foot assemblies include support braces having forward ends which ride back and forth on the front portions of the track assemblies.

The articulated cam follower assemblies include roller frames for holding and rotatably mounting the cam rollers thereon, and cam follower links pivotally connected to the roller frames. Each roller frame has a front end pivotally connected to the machine frame, and a back end pivotally secured to an upper end of each cam follower link. A lower end of each cam follower link is pivotally attached to the front end of each track assembly. The linkage arrangement includes a pair of swing arms pivotally attached to the machine frame, a pair of forward connecting links having forward ends pivotally connected to the cams and rearward ends connected to the swing arms, and a pair of rearward connecting links having forward ends pivotally connected to the swing arms and rearward ends pivotally connected to the foot assemblies. In the exercise machine, the shaft defines a first horizontal pivot axis. The cam follower assemblies are pivotally connected about a second horizontal pivot axis. The rear ends of the track assemblies are pivotally attached about a third horizontal pivot axis. The linkage arrangement is pivotally secured about a fourth horizontal pivot axis.

The invention further contemplates a method of walking/jogging in an exercise machine. The method includes the steps of providing a machine frame supported on a generally horizontal floor; mounting a shaft for rotation on the frame; mounting a pair of cams for rotation on the shaft; movably mounting a pair of track assemblies to the frame; pivotally mounting a pair of articulated cam follower assemblies between the frame and the track assemblies such that the cam follower assemblies include cam rollers that operably engage peripheries of the cam; providing a pair of foot assemblies for sliding movement on the track assemblies; and providing a linkage arrangement between the cams and the foot assemblies for transferring movement of the foot assemblies to the cams such that the articulated cam follower assemblies enable a leverage range of up and down movement of the track assemblies to produce an increase in bending of a user's knees resulting in a natural stepping motion.

Various other objects, features and advantages of the invention will be made apparatus from the following description taken together with the drawings.

BRIEF DESCRIPTION OF THE DRAWINGS

The drawings illustrate the best mode presently contemplated in carrying out the invention.

In the drawings and the specification, the terms front, rear, right and left are used herein from the perspective of a user facing the exercise machine.

DETAILED DESCRIPTION OF THE INVENTION

Figure 1:
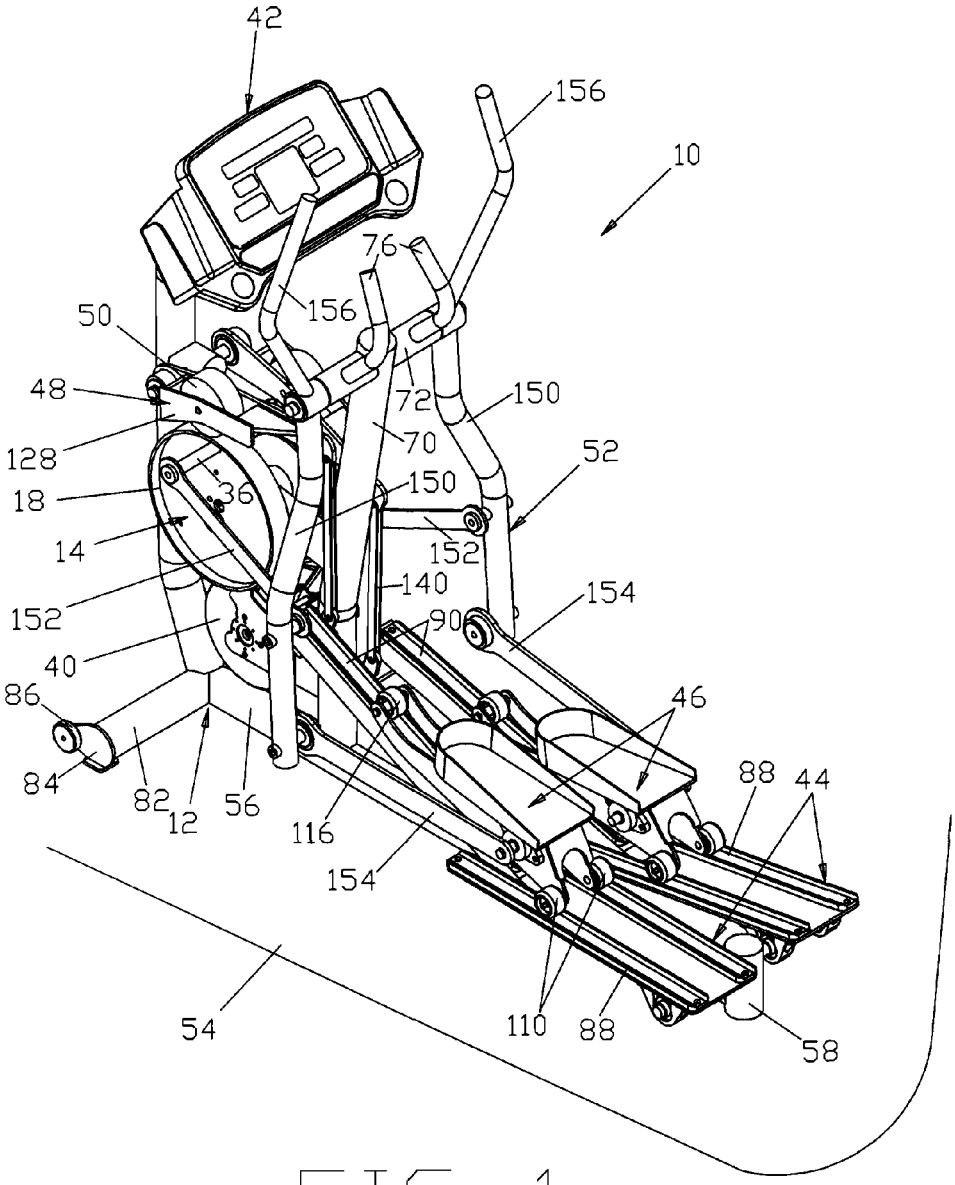
FIG. 1 is a front perspective view of a low impact walking/jogging machine constructed in accordance with the invention.

The present invention is advantageously directed to an improved exercise machine which primarily moves a user's feet and legs through a natural range of striding and stepping motion associated with walking, jogging and running.

General Overview

Referring now to the drawings, FIGS. 1-6 illustrate the structure of an exercise machine 10 constructed in accordance with the invention.

Figure 2:
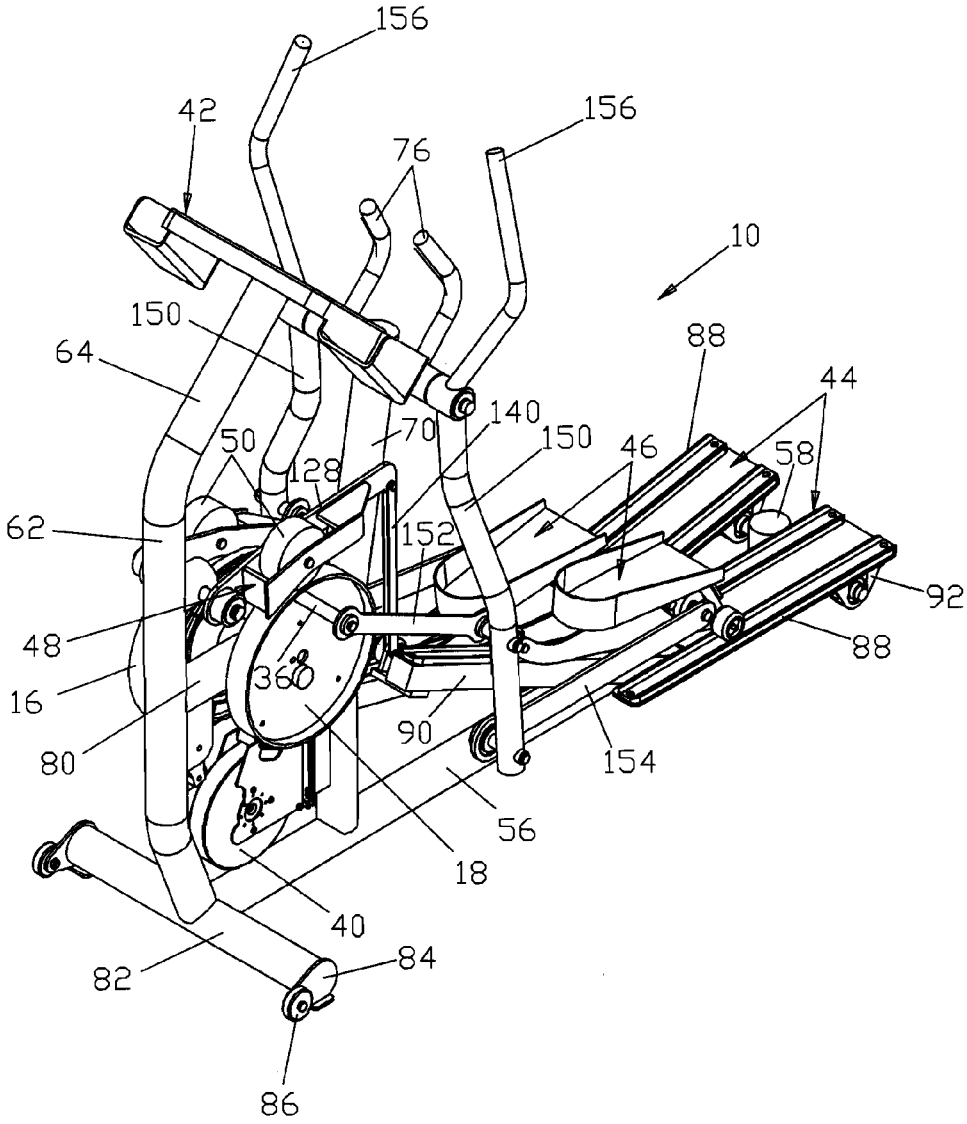
FIG. 2 is a rear perspective view of the exercise machine of FIG. 1 taken from a left side.
Figure 3:
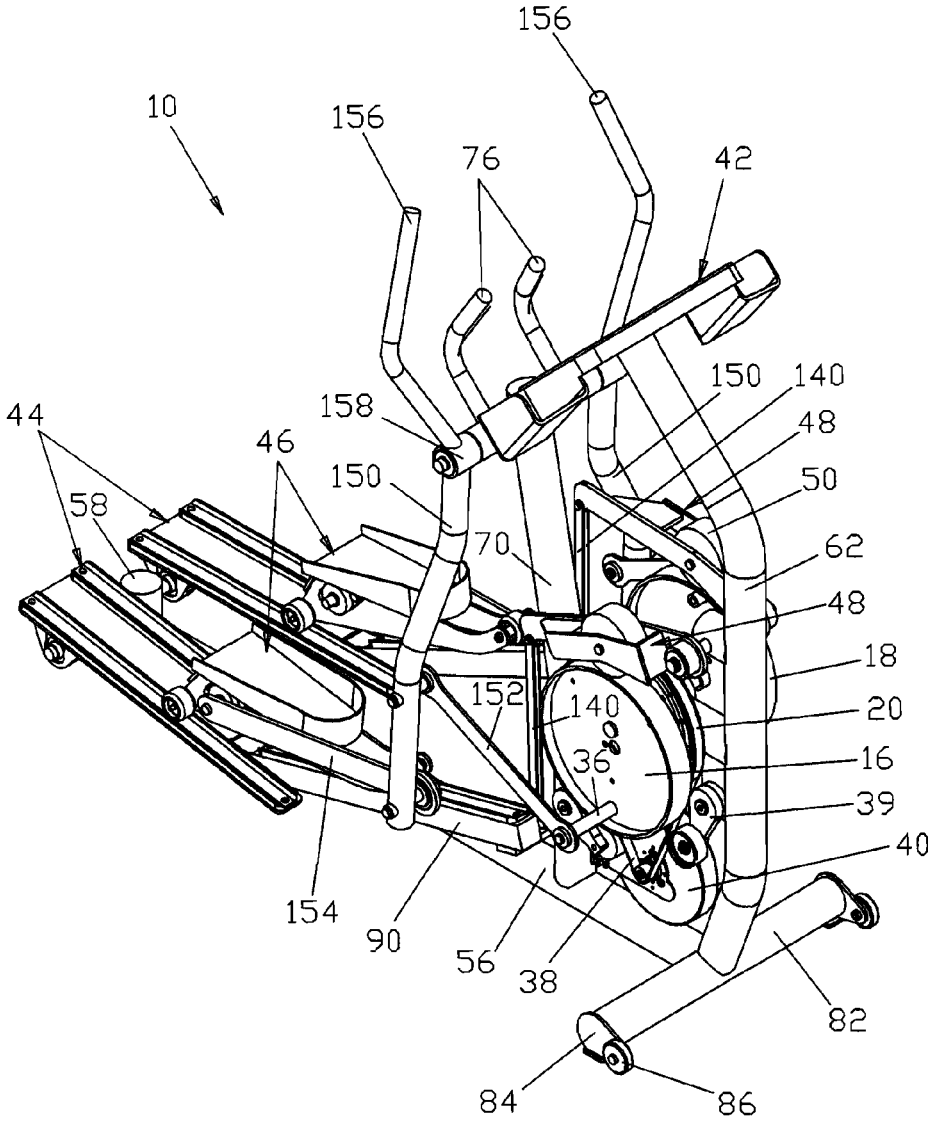
FIG. 3 is a rear perspective view of the exercise machine of FIG. 1 taken from a right side.
Figure 4:
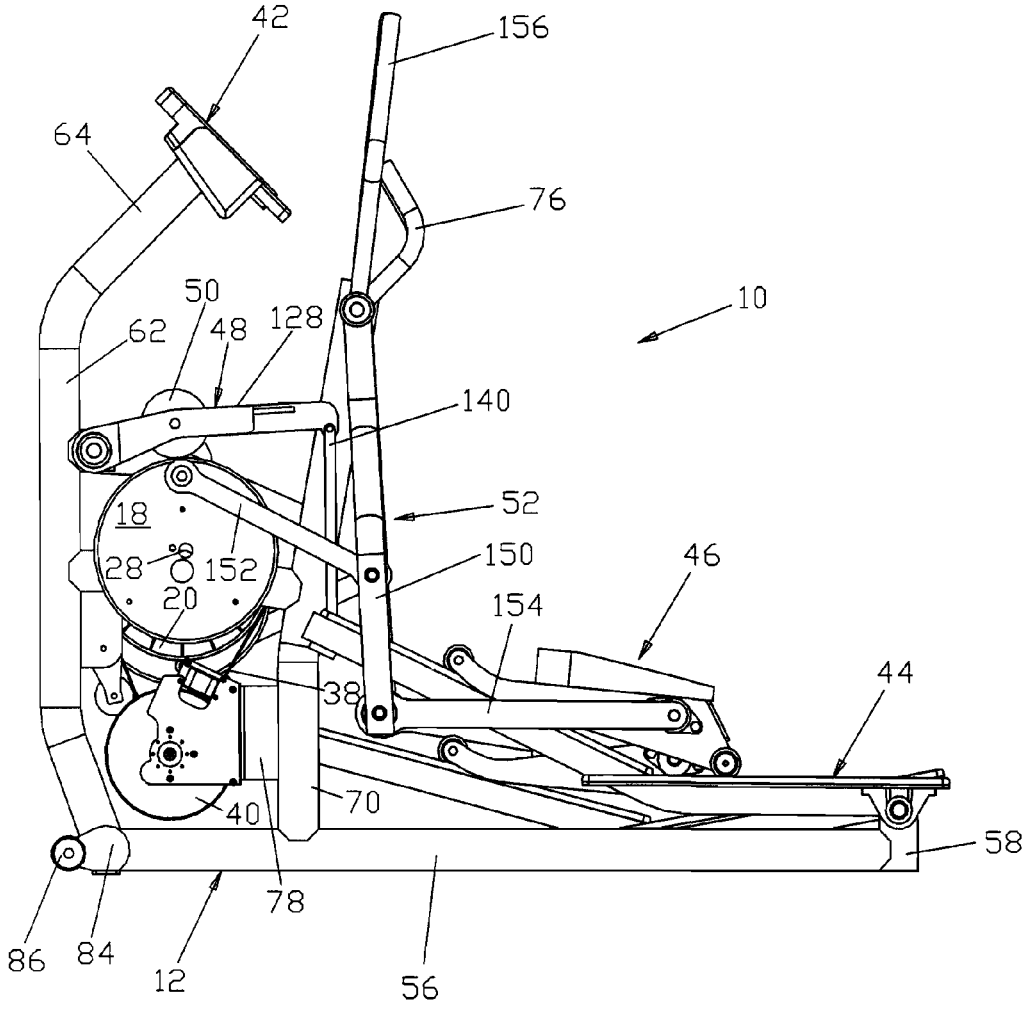
FIG. 4 is a left side elevational view of FIG. 1.
Figure 5:
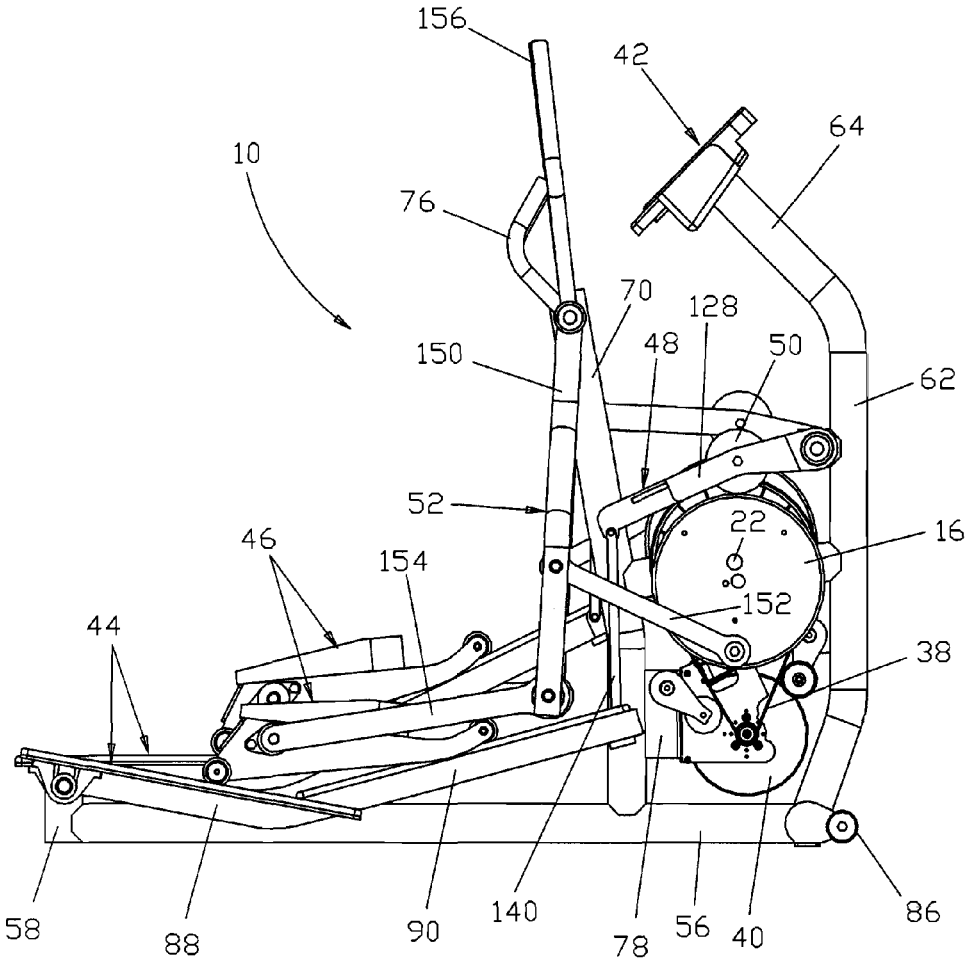
FIG. 5 is a right side elevational view of FIG. 3.
Figure 6:
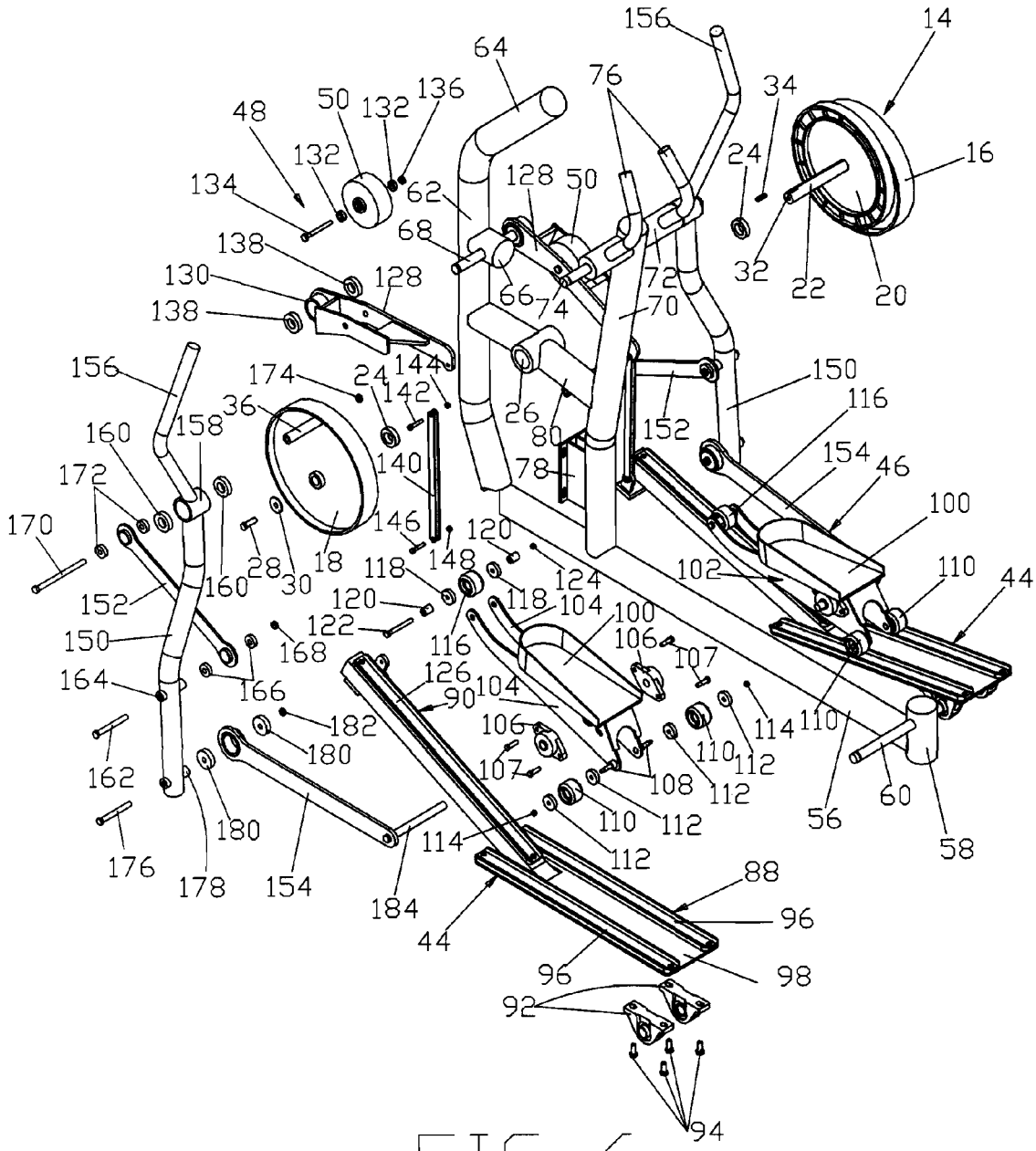
FIG. 6 is an exploded view of the exercise machine in FIG. 1 with certain parts being removed for clarity.

The exercise machine 10 is designed with a left side and right side which are substantially identical. The left side and the right side are staggered in such a manner such that when the user's left foot is at an extreme rear extent of travel, the right foot is at an extreme forward extent of travel. This arrangement employs a machine frame 12 for mounting a cam assembly 14 generally comprised of a pair of right hand and left hand cams 16,18, a circular drive pulley 20 and an internally threaded connecting shaft 22 as best seen in FIGS. 2 and 6. The right hand cam 16 and the drive pulley 20 are welded to the connecting shaft 22 such that the right hand cam 16 is elliptically fixed relative to the drive pulley 20 with the shaft 22 passing through the center of the drive pulley 20. The shaft 22 passes through a set of bearings 24 and a pivot tube 26 provided on the frame 12, and further passes through an offset hole formed in the left hand cam 18. The left hand cam 18 is joined to the shaft 22 with a bolt 28 and a washer 30 so that the cams 16,18 and drive pulley 20 are rotatably mounted together relative to the frame 12. The left hand cam 18 and the shaft 22 have a keyway 32 (FIG. 6) machined into them into which a key 34 is placed to lock the left hand cam 18 into a fixed position with the right hand cam 16 so that the high points of the cams 16,18 are located 180° opposite each other. Each of the cams 16,18 has a tubular connecting shaft 36 extending outwardly therefrom. The drive pulley 20 is connected with a drive belt 38 to a generator/brake assembly 40 mounted to the frame 12. Belt tensioning structure 39 (FIG. 3) is provided to prevent slippage of the drive belt 38. The brake assembly 40 is operably connected by wires or the like to an electronic controller 42 positioned upwardly on the frame 12. This braking system provides resistance to rotation of the drive pulley 20 and other interconnected components to be described to vary the difficulty of the exercise. It should be understood that other resistance devices, such as a simple brake, could be used.

The machine 10 has a pair of movable track assemblies 44 for slidably receiving a pair of foot assemblies 46 which move in a back and forth motion relative to the frame 12 and each other. A pair of articulated cam follower assemblies 48 extend between the frame 12 and front ends of the track assemblies 44. The cam follower assemblies 48 are provided with cam rollers 50 which ride upon outer peripheries of the cams 16,18 during operation of the machine 10. A movable linkage arrangement 52 is provided between the cams 16,18 and the foot assemblies 46 for transferring movement from the foot assemblies 46 to the cams 16,18. As will be appreciated below, the cooperation of the above-described major components results in a substantially enhanced, natural stepping and striding motion.

Component Details

The exercise machine frame 12 rests upon a floor 54, and includes a tubular base member 56 running from a front end to a rear end. The rear end is provided with a cylindrical endpiece 58 having a pivot shaft 60 that projects laterally from each side of the endpiece 58. A first upwardly rising support member 62 is joined to the front end of the base member 56, and has a rearward bent neck 64 for supporting the electronic controller 42. The first support member 62 also carries a cylindrical support stub 66 having a pivot shaft 68 extending laterally from opposite sides for pivotally supporting the cam follower assemblies 48 from the frame 12. A second upwardly rising support member 70 is fixed to the base member 56 rearwardly of the first support member 62. The second support member 70 has a cross tube 72 at its upper end having a pivot shaft 74 projecting from opposite ends. The cross tube 72 carries a pair of spaced apart fixed handgrips 76 which may be grasped by a user during operation, if desired. As seen best in FIG. 6, the bottom end of the second support member 70 includes an attachment bracket 78 for mounting the brake assembly 40. A support brace 80 interconnects the first and second support members 62,70, and is provided with a pivot tube 26 holding the bearings 24 through which the connecting shaft 22 passes. A transverse support member 82 is fixed to the front end of the base member 56 and the bottom end of the first support member 62 for engagement with the floor 54, and provides lateral stability for the machine 10. Opposite ends of the transverse support member 82 have mounting plates 84 carrying wheels 86 which enable moving of the machine 10 when it is lifted from its rear end.

Each movable track assembly 44 includes a horizontally extending rear portion 88 fixedly joined to an angled front portion 90. More particularly, each front portion 90 extends at an acute angle relative to a horizontal plane of an upper surface of each rear portion 88. Each rear portion 88 has a rear end provided with a set of pillow block bearings 92 that are attached to a bottom end using fasteners 94 (FIG. 6). The pillow block bearings 92 are pivotally attached to the pivot shaft 60 at the rear end of the base member 56 so that the rear ends of the track assemblies 44 pivot on the rear of the frame 12. Each rear portion 88 has a pair of spaced apart tracks 96 on a flat base plate 98. The front portions 90 form single tracks and have front ends which are pivotally connected to the cam follower assemblies 48. The rear portions 88 support back portions of the foot assemblies 46, while the front portions 90 support forward portions of the foot assemblies 46. Each track assembly 44 is designed to pivot as a unit.

As seen best in FIG. 6, each of the foot assemblies 46 includes a walled foot pedal 100 for positioning the user's foot thereon. The foot pedal 100 is mounted on a support base 102 having a pair of spaced apart plates 104. Pillow block bearings 106 are attached by bolts 107 to lateral surfaces of the support plates 104. Rearward ends of the plates 104 have laterally extending pins 108 for holding a pair of rotatable rear wheels 110, bearings 112 and nuts 114. Forward extended ends of the plates 104 retain a single rotatable front wheel 116 attached through bearings 118 and spacer bushings 120 with a bolt 122 into a nut 124. The rear wheels 110 are rollably engaged with the tracks 96 on the rear portions 88 of the movable track assemblies 44. The single front wheels 116 are rollably engaged with the single tracks 126 formed by the front portions 90 of the movable track assemblies 44.

Each of the articulated cam follower assemblies 48 has a roller frame 128 having a cylindrical cuff 130 at a forward end, and a mounting hole at a rearward end thereof. Each cam roller 50 that rides on the eccentric periphery of its cam 16,18 is rotatably mounted within the roller frame 128 on bearings 132 and is retained by a bolt 134 held by a nut 136. The forward end of each roller frame 128 is pivotally mounted on the pivot shaft 68 of machine frame first support member 62 via pop-in bearings 138 inserted in the cuff 130. Each articulated cam follower assembly 48 further includes a straight cam follower link 140 having an upper end pivotally attached by a pin 142 and nut 144 to the rearward end of the cam roller frame 128. Each link 140 has a lower end pivotally connected by a pin 146 and a nut 148 to the front portion 90 of one of the track assemblies 44. As a feature of the present invention, it will be appreciated that the articulated cam follower assemblies 48 permit an enhanced up and down motion of the track assemblies 44 which improves the natural stepping motion of the machine 10.

The linkage arrangement 52 has a pair of swing arms 150 pivotally attached to the machine frame 10. A pair of forward connecting links 152 has forward ends pivotally connected to the cams 16,18, and the rearward ends pivotally joined to the swing arms 150. A pair of rearward connecting links 154 has forward ends pivotally connected to the swing arms 150, and rearward ends pivotally to the foot assemblies 46.

More specifically, each swing arm 150 is formed with an upwardly extending handle 156 and includes a pivoting tubular cuff 158 holding pop-in bearings 160 which surround pivot shaft 74 on the second support member 70. A bolt 162 passes through a first horizontal tube 164 in the swing arm 150 as well as through pop-in bearings 166 provided at a rearward end of each forward connecting link 152. The inner end of the bolts 162 receives a nut 168 to hold the forward connecting link 152 and swing arm 150 together. A further bolt 170 passes through pop-in bearings 172 at the forward end of the forward connecting link 152 and the tubular connecting shaft 36 projecting from cams 16,18. An inner end of the bolt 170 is threaded into a nut 174 to maintain the pivotal connection of the front of the forward connecting link 152 to the cams 16,18. Another bolt 176 passes through a second lower tube 178 in the swing arm 150 as well as through pop-in bearings 180 provided at a forward end of the rearward connecting link 154. The inner end of the bolt 176 is threaded into a nut 182 to pivotally hold the rearward connecting link 154 and the bottom of swing member 150 together. The rearward end of each rearward connecting link 154 has a rod 184 which is pivotally connected to one of the pillow block bearings 106 attached to one of the foot assemblies 46.

It can be seen that the cams 16,18 are pivotally mounted about a first horizontal pivot axis defined by the connecting shaft 22. The cam follower assemblies 48 are pivotally mounted about a second horizontal pivot axis defined by the pivot shaft 68. The track assemblies 46 are pivotally mounted about a third horizontal pivot axis defined by the pivot shaft 60. The swing arms 50 are pivotally mounted about a fourth horizontal pivot axis defined by the pivot shaft 74.

Operation

Figure 7A:
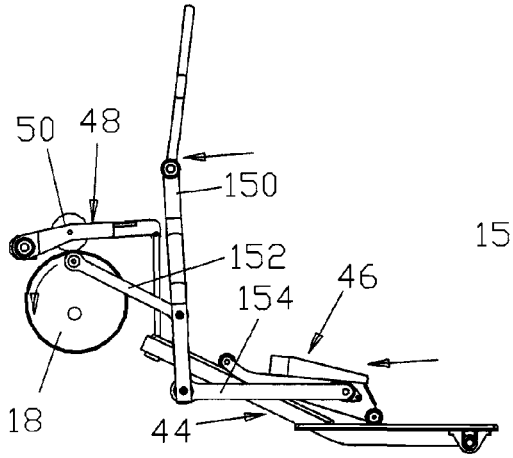
FIGS. 7*a*-7*d* are simplified diagrams showing the sequence of motion of the exercise machine.
Figure 7B:
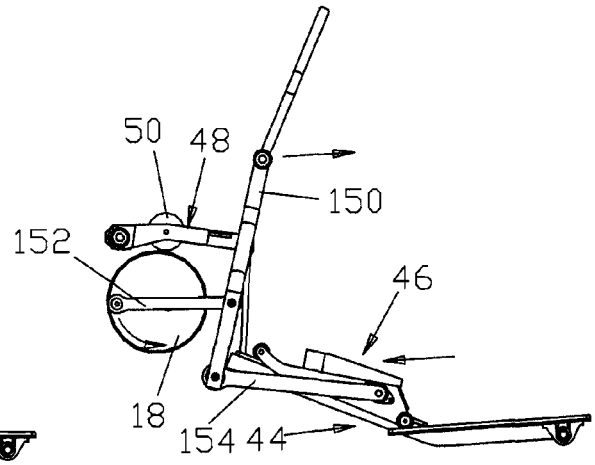

FIGS. 7*a*-7*b* illustrate the sequence of movement in the operation of the exercise machine 10 as viewed from the left side thereof. In FIG. 7*a*, the left foot assembly 46 is moved forward from its rearwardmost position on track assembly 44 causing the rearward connecting link 154 to propel the swing arm 150 forwardly. This motion is translated through the forward connecting link 152 to result in rotation of the cam 18. As the cam roller 50 rises along the irregular moving periphery of the cam 18, the articulated cam follower assembly 48 initiates a downward motion at the front of the moving track assembly 44.

Downward motion of the track assembly 44 continues as the foot assembly 46 moves to a forwardmost toe-up position shown in FIG. 7*b*. At this point, further movement of the foot assembly 46 causes the swing arm 150 to move rearwardly. The combined forward movement of the foot assembly 46 on the pivoting track assembly 44 has the effect of raising the user's foot and changing the angle of the user's ankle as happens while striding and stepping forward.

Figure 7C:
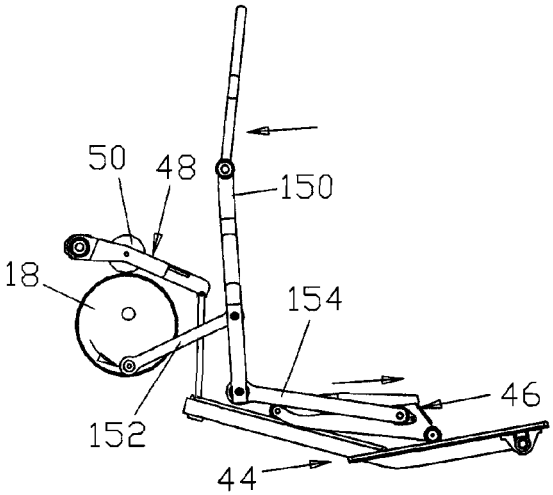
Figure 7D:
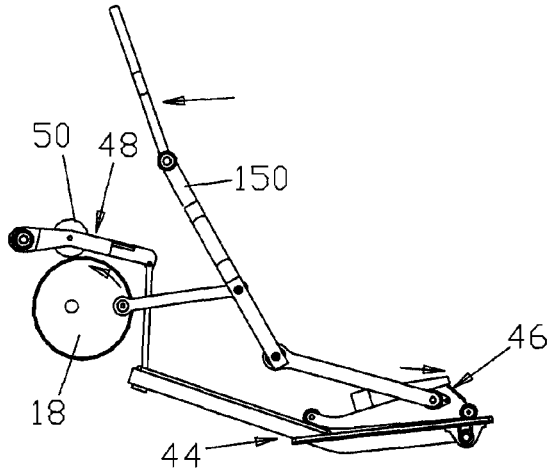

FIG. 7*c* shows a foot assembly 46 reversing in a rearward direction causing further downward motion at the front of the track assembly 44 and forward movement of the swing arm 150 as the ankle position of the user continues to change. In FIG. 7*d*, the foot assembly 46 has been moved to its rearwardmost position, causing the swing arm 150 to move further forwardly. Here, the cam follower assembly 48, reacting to the repositioning of the cam 18, begins moving upward. This causes raising of the front of the track assembly 44 as a user's foot assumes a toe-down position. As the left side foot assembly 46 is driven forward causing the left hand cam 18 to rotate, the right hand assembly 44 is driven rearwardly causing the right side cam 16 to rotate so as to create a natural walking/jogging motion.

It should be fully appreciated that during the entire sequence of motion, the articulated cam follower assemblies 48 enable a leveraged range of an alternating up and down motion of the track assemblies 44. This produces an increase in flexure or bending of the user's knees, which together with the heel-to-toe movement of the user's feet, results in an enhanced natural stepping and striding motion and effective lower body exercise. Upper body exercise is simultaneously obtained by moving the swing arms 150 back and forth. Alternatively, the user may choose to hold onto the fixed hand grips 76, if only lower body exercise is desired.

During motion of the machine 10, the drive pulley 20 will rotate. Because the drive pulley 20 is connected by the drive belt 38 to the brake assembly 40 and the electronic controller 42, a varying level of resistance is provided to vary the difficulty of the exercise. The electronic controller 42 is preferably battery-powered and designed to provide a set of various walking or jogging programs. The controller 42 can also be variously programmed to reflect distance traveled, time elapsed, calories burned and other desirable parameters.

Various alternatives and embodiments are contemplated as being within the scope of the following claims particularly pointing out and distinctly claiming the subject matter regarded as the invention.

I claim:

1. A walking/jogging exercise machine comprising:

a machine frame supported upon a generally horizontally extending floor;

a shaft mounted for rotation on the machine frame;

a pair of cams mounted for rotation on the shaft;

a pair of movable track assemblies having rear portions with rear ends pivotally connected to the machine frame, and front portions with movable front ends;

a pair of articulated cam follower assemblies having first ends pivotally mounted on the machine frame extending to and the front ends of the track assembly front portions, and including cam rollers operably engaged upon peripheries of the cams, the cam follower assemblies moving in response to rotation of the cams;

a pair of foot assemblies mounted for sliding movement on the track assemblies; and a linkage arrangement between the cams and the foot assemblies for transferring movement of the foot assemblies to the cams such that the articulated cam follower assemblies enable a leveraged range of up and down movement of the track assemblies to produce an increase in bending of a user's knees resulting in an enhanced natural stepping motion during exercise.

2. The exercise machine of claim 1, wherein the machine frame includes an elongated base member engaged with the floor, a first upwardly rising support member joined to the base member, a second upwardly rising support member spaced rearwardly of the first support member and fixed to the base member, a support brace interconnecting the first and second support members, and a transverse support member joined to the first support member and the base and engaged with the floor.

3. The exercise machine of claim 1, wherein a circular drive pulley is mounted for rotation on a shaft between the cams.

4. The exercise machine of claim 3, wherein a brake assembly is attached to the machine frame beneath the cams, and is entrained with the drive pulley by a drive belt.

5. The exercise machine of claim 4, wherein the machine frame carries an electronic controller operably connected to the brake assembly for providing resistance to the drive pulley.

6. The exercise machine of claim 1, wherein the rear portions of the track assemblies extend horizontally, and the front portions of the track assemblies extend at an angle relative to the rear portions and are formed integrally therewith.

7. The exercise machine of claim 6, wherein each front portion of the track assemblies extend at an acute angle relative to a horizontal plane of an upper surface of each rear portion.

8. The exercise machine of claim 1, wherein the foot assemblies include support bases having rearward ends which ride back and forth on the rear portions of the track assemblies.

9. The exercise machine of claim 1, wherein the foot assemblies include support bases having forward ends which ride back and forth on the front portions of the track assemblies.

10. The exercise machine of claim 1, wherein the articulated cam follower assemblies include a roller frame for holding and rotatably mounting the cam rollers thereon, and cam follower links pivotally connected to the roller frames.

11. The exercise machine of claim 10, wherein each roller frame has a front end pivotally mounted to the machine frame, and a back end pivotally secured to an upper end of each cam follower link.

12. The exercise machine of claim 11, wherein a lower end of each cam follower link is pivotally attached to the front end of each track assembly.

13. The exercise machine of claim 1, wherein the linkage arrangement includes:

a pair of swing arms pivotally attached to the machine frame;

a pair of forward connecting links having forward ends pivotally connected to the cams, and rear ends pivotally connected to the swing arms; and a pair of rearward connecting links having forward ends pivotally connected to the swing arms, and rear ends pivotally connected to the foot assemblies.

14. The exercise machine of claim 1, wherein the shaft is rotatably mounted about a first horizontal pivot axis, the cam follower assemblies are pivotally mounted about a second horizontal pivot axis, the rear ends of the track assemblies are pivotally attached about a third horizontal pivot axis, and the linkage arrangement is pivotally secured about a fourth horizontal pivot axis.

15. A method for walking/jogging in an exercise machine, the method comprising the steps of:

providing a machine frame supported on a generally horizontal floor;

mounting a shaft for rotation on the frame;

mounting a pair of cams for rotation on the shaft;

movably mounting a pair of track assemblies to the frame;

pivotally mounting a pair of articulated cam follower assemblies at one end to the frame and extending to the track assemblies such that the cam follower assemblies include cam rollers that operably engage peripheries of the cams;

mounting a pair of foot assemblies for sliding movement on the track assemblies; and providing a linkage arrangement between the cams and the foot assemblies for transferring movement of the foot assemblies to the cams such that the articulated cam follower assemblies enable a leveraged range of up and down movement of the track assemblies to produce an increase in bending of a user's knees resulting in a natural stepping motion during exercise.

* * * * *

UNITED STATES PATENT AND TRADEMARK OFFICE

CERTIFICATE OF CORRECTION

PATENT NO. : 7,591,761 B1
APPLICATION NO. : 11/413037
DATED : September 22, 2009
INVENTOR(S) : Patrick D. Ellis It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 632 days.

Signed and Sealed this

Twenty-first Day of September, 2010

David J. Kappos

David J. Kappos
*Director of the United States Patent and Trademark Office*